US009970460B2

(12) United States Patent
Malisi et al.

(10) Patent No.: US 9,970,460 B2
(45) Date of Patent: May 15, 2018

(54) FAN UNIT

(71) Applicant: BSH HAUSGERAETE GMBH

(72) Inventors: Michaela Malisi, Heidenheim (DE); Rainer Weser, Gundelfingen (DE)

(73) Assignee: BSH Hausgeraete GmbH, Munich (DE)

( * ) Notice: Subject to any disclaimer, the term of this patent is extended or adjusted under 35 U.S.C. 154(b) by 325 days.

(21) Appl. No.: 14/434,176

(22) PCT Filed: Oct. 1, 2013

(86) PCT No.: PCT/EP2013/070392
§ 371 (c)(1),
(2) Date: Apr. 8, 2015

(87) PCT Pub. No.: WO2014/056752
PCT Pub. Date: Apr. 17, 2014

(65) Prior Publication Data

US 2015/0292520 A1 Oct. 15, 2015

(30) Foreign Application Priority Data

Oct. 9, 2012 (DE) ..... 10 2012 218 347

(51) Int. Cl.

| | |
|---|---|
| ***F04D 29/62*** | (2006.01) |
| ***F25D 17/06*** | (2006.01) |
| ***F04D 29/60*** | (2006.01) |
| ***F04D 29/66*** | (2006.01) |
| ***F04D 17/00*** | (2006.01) |

(Continued)

(52) U.S. Cl.
CPC ..... *F04D 29/626* (2013.01); *F04D 17/00* (2013.01); *F04D 29/281* (2013.01); *F04D 29/4226* (2013.01); *F04D 29/601* (2013.01); *F04D 29/668* (2013.01); *F25D 17/062* (2013.01); *F25D 2317/0681* (2013.01); *F25D 2317/0683* (2013.01)

(58) Field of Classification Search
CPC .... F04D 29/281; F04D 29/601; F04D 29/626; F04D 29/668; F04D 29/4226; F04D 29/4253; F04D 25/12; F04D 17/00; F25D 17/062; F25D 2317/0681; F25D 2317/0683
See application file for complete search history.

(56) References Cited

U.S. PATENT DOCUMENTS 5,997,254 A 12/1999 Tosaki
6,000,919 A * 12/1999 Hsieh ..... F04D 29/646 415/220

(Continued)

FOREIGN PATENT DOCUMENTS

CN 2523174 Y 11/2002
CN 101469723 A 7/2009

(Continued)

*Primary Examiner* — Kenneth Bomberg
*Assistant Examiner* — Hoon Choi
(74) *Attorney, Agent, or Firm* — Laurence A. Greenberg; Werner H. Stemer; Ralph E. Locher

(57) ABSTRACT

A refrigeration device or appliance has a fan assembly which is mounted in a housing with a housing front side part and a housing rear side part, and the fan assembly is secured to the housing rear side part and is held in place by the housing front side part.

14 Claims, 8 Drawing Sheets

(51) Int. Cl.
*F04D 29/28* (2006.01)
*F04D 29/42* (2006.01)

(56) References Cited

U.S. PATENT DOCUMENTS

| | | | | |
|---|---|---|---|---|
| 6,351,380 | B1 * | 2/2002 | Curlee | F16B 5/065 165/80.3 |
| 7,317,267 | B2 | 1/2008 | Schmid et al. | |
| 8,337,155 | B2 * | 12/2012 | Yoo | F04D 29/668 361/679.48 |
| 2003/0039546 | A1 | 2/2003 | Liu | |
| 2005/0095121 | A1 * | 5/2005 | Vithani | F04D 29/626 415/121.2 |
| 2005/0173997 | A1 | 8/2005 | Schmid et al. | |
| 2009/0169387 | A1 | 7/2009 | Yoo et al. | |
| 2010/0028144 | A1 | 2/2010 | Hung et al. | |

FOREIGN PATENT DOCUMENTS

| | | | |
|---|---|---|---|
| CN | 101639083 | A | 2/2010 |
| JP | H0347500 | A | 2/1991 |
| RU | 2401961 | C2 | 10/2010 |
| RU | 2405118 | C2 | 11/2010 |
| WO | 03089858 | A1 | 10/2003 |

* cited by examiner

FAN UNIT

BACKGROUND OF THE INVENTION

Field of the Invention

The invention relates to a fan unit for a refrigeration device, comprising a fan module, wherein the fan module is accommodated in a housing, wherein the housing has a housing front side part and a housing rear side part connected to the housing front side part.

Refrigeration devices, in particular refrigeration devices realized in the form of domestic appliances, are known and utilized for household management in households or in the catering industry in order to store perishable foodstuffs and/or beverages at specific temperatures. Refrigeration devices of this type have a motor-driven fan for circulating air, which fan has a fan wheel and a flange, the flange being connected to a bracket by means of screws for the purpose of assembly. This fan module is then inserted into a housing and the two-part housing screwed together. The fan module in the housing forms a fan unit which is built into a chilled goods container of the refrigeration device. Making a screw connection is expensive, however, and can result in damage to the fan shaft and/or the fan bearing. Apart from this, making a screw connection can be subject to considerable quality fluctuations since in the first place individual screws are forgotten or screws are insufficiently tightened.

BRIEF SUMMARY OF THE INVENTION

The object underlying the invention is therefore to provide a fan module which is simpler to assemble.

This object is achieved by the subject matter with the features as claimed in the independent claim. Advantageous embodiments form the subject matter of the dependent claims, the description, and also the drawings.

According to a first aspect, the inventive object is achieved by a refrigeration device comprising a fan module which is accommodated in a housing comprising a housing front side part and a housing rear side part, in which the fan module is secured to the housing rear side part and is held in place by means of the housing front side part. The fan module can be slipped onto the housing rear side part. This achieves the technical advantage that production is simplified and at the same time the logistics outlay for production is reduced since neither fixing means, such as screws, nor tools for making a screw connection have to be kept ready or provided, respectively. At the same time, quality is improved since production becomes less susceptible to defects as a result of the simplified assembly.

In an advantageous embodiment, the housing rear side part incorporates at least one support stud for slipping on the fan module. In general, however, the support studs can also be arranged on the housing front side part. This achieves the technical advantage that the assembly of the fan module is further simplified, for example.

In a further advantageous embodiment, the housing rear side part incorporates three support studs for slipping on the fan module. This achieves the technical advantage that the stability of any securing of the fan module is increased, for example.

In a further advantageous embodiment, the three support studs are arranged in a circle at an angle of 120° to each other respectively. This achieves the technical advantage that the fan module is mounted particularly evenly, for example.

In a further advantageous embodiment, a decoupling element is arranged between the support stud and the fan module. This achieves the technical advantage that vibrations of the fan module are not transmitted to the housing, for example.

In a further advantageous embodiment, the decoupling element is a flexible rubber molding. This achieves the technical advantage that the damping element can be implemented at low cost, for example.

In a further advantageous embodiment, the decoupling element can be slipped onto the support stud. This achieves the technical advantage that the assembly of the fan module is simplified even further, for example.

In a further advantageous embodiment, the support stud incorporates a pin segment with a stop for slipping on the fan module. This achieves the technical advantage that the fan module can be positioned precisely, for example.

In a further advantageous embodiment, the support stud is formed as one continuous piece with the housing rear side part. This achieves the technical advantage that the manufacturing of the housing and its stability are improved, for example.

In a further advantageous embodiment, the support stud is cylindrical in shape. This achieves the technical advantage that the support stud can be manufactured with a high level of strength, for example.

In a further advantageous embodiment, the support stud is in contact with an end support for holding the fan module in place. This achieves the technical advantage that any displacement of the fan module is prevented, for example.

In a further advantageous embodiment, the end support is a projecting segment of the housing front side part. In general, however, the end support can also be arranged in the housing rear side part. This achieves the technical advantage that the end support can be manufactured together with the housing front side part, for example.

In a further advantageous embodiment, the fan module incorporates a bracket for slipping on the fan module and for holding a fan wheel. This achieves the technical advantage that the fan module can be secured to the housing rear side part by way of the bracket, for example.

In a further advantageous embodiment, the housing front side part incorporates a housing front side latch element for latching in the housing rear side part or the housing rear side part incorporates a housing rear side latch element for latching in the housing front side latch element. This achieves the technical advantage that the housing can be closed in a simple manner, for example.

In a further advantageous embodiment, the fan module is clamped between the housing front side part and the housing rear side part. This achieves the technical advantage that the fan module is held in place particularly effectively.

BRIEF DESCRIPTION OF THE SEVERAL VIEWS OF THE DRAWING

Further exemplary embodiments are explained by referring to the enclosed drawings. In the drawings.

DESCRIPTION OF THE INVENTION

Figure 1:
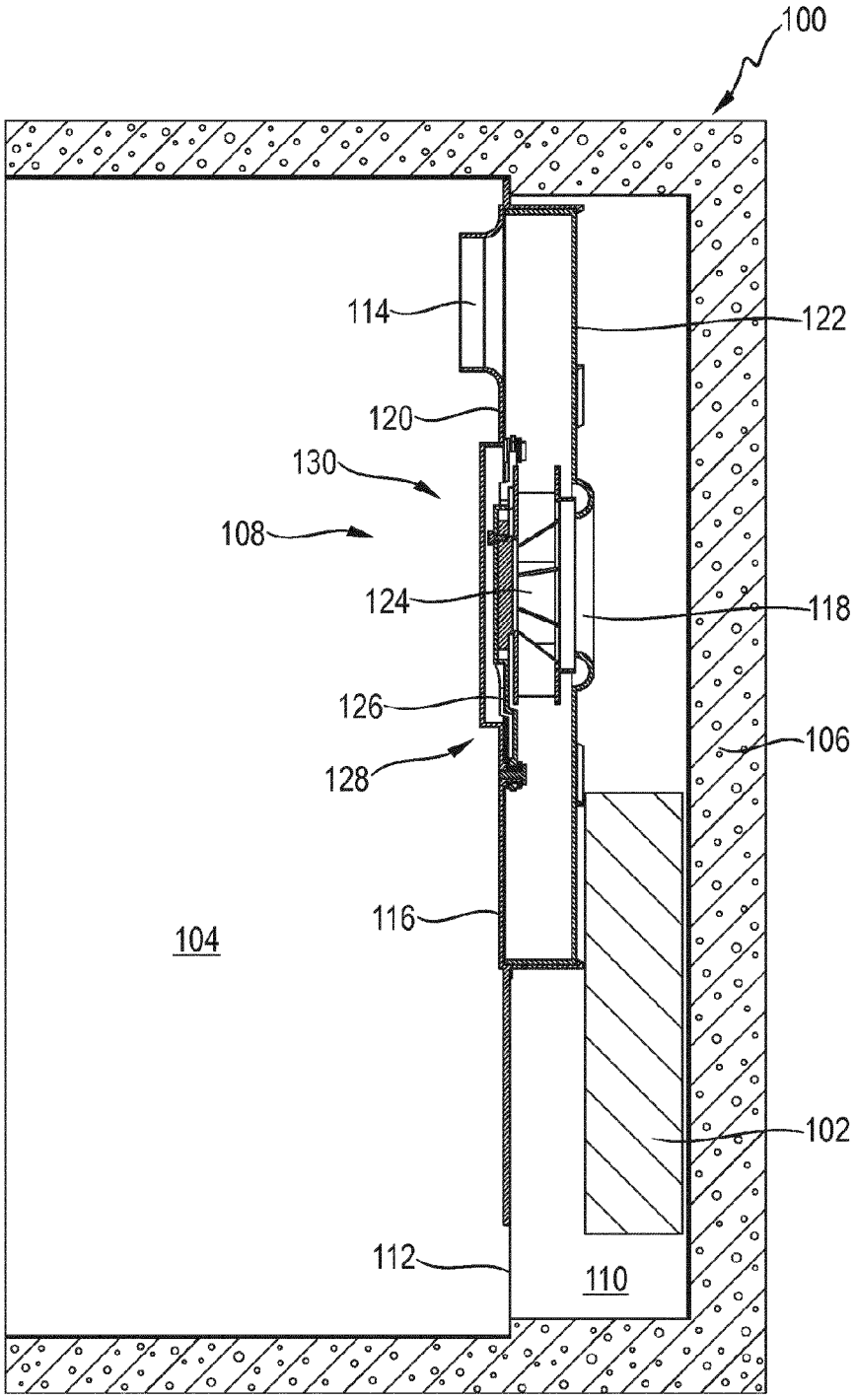
FIG. 1 shows a section through a refrigeration device.

For the purpose of cooling frozen or chilled goods, the refrigeration device 100 has a coolant circuit with an evaporator 102, a compressor (not shown), a condenser (not shown), and a throttle device (not shown).

The evaporator 102 is realized in the form of a heat exchanger in which, following an expansion phase, the liquid coolant is evaporated by the absorption of heat from the medium to be cooled, i.e. air in the interior of the refrigerator.

The compressor is a mechanically driven component that draws off coolant vapor from the evaporator and pushes it out at a higher pressure to the condenser.

The condenser is realized in the form of a heat exchanger in which, following the compression phase, the evaporated coolant is condensed by the emission of heat to an external cooling medium, i.e. the ambient air.

The throttle device is an apparatus for constantly reducing pressure by means of the reduction of cross-section.

The coolant is a fluid that is used for heat transfer in the cold-generating system, which absorbs heat at low temperatures and low pressure of the fluid and emits heat at higher temperature and higher pressure of the fluid, changes of state of the fluid usually being included.

Furthermore, the refrigeration device 100 has an inner container 104 for accommodating frozen or chilled goods, which is surrounded by a heat-insulating layer of hardened foam in the present exemplary embodiment.

In the inner container 104, a fan unit 130 with a fan module 108 and an air duct 110 are provided as well as the evaporator 102.

In the present exemplary embodiment, the air duct 110 has an air inlet opening 112 and an air outlet opening 114. During operation, air is drawn in from the inner container 104 and conducted to the evaporator by the fan module 108, and then fed back through the air outlet opening 114 again and into the inner container 104 again by the fan module 108.

In the present exemplary embodiment, the fan module 108 is accommodated in a housing 116 which has an intake nozzle 118 through which air can enter the housing 116 from the air duct 110. Furthermore, in the present exemplary embodiment, the air outlet opening 114 is assigned to the housing 116 so that in the present exemplary embodiment air can be fed from the housing 116 directly into the inner container 104.

In the present exemplary embodiment, the housing 116 has a housing front side part 120 and a housing rear side part 122. In the present exemplary embodiment, both the housing front side part 120 and also the housing rear side part 122 are produced from plastic, e.g. by way of injection molding.

In the present exemplary embodiment, the fan module 108 has a motor-driven fan wheel 124 and a bracket 126. In the present exemplary embodiment, the fan wheel 124 is realized in the form of a radial fan. In the present exemplary embodiment, the fan wheel 124 is connected to the bracket 126 by a latch connection 128, and the bracket 126 is connected to the housing 116.

Figure 2:
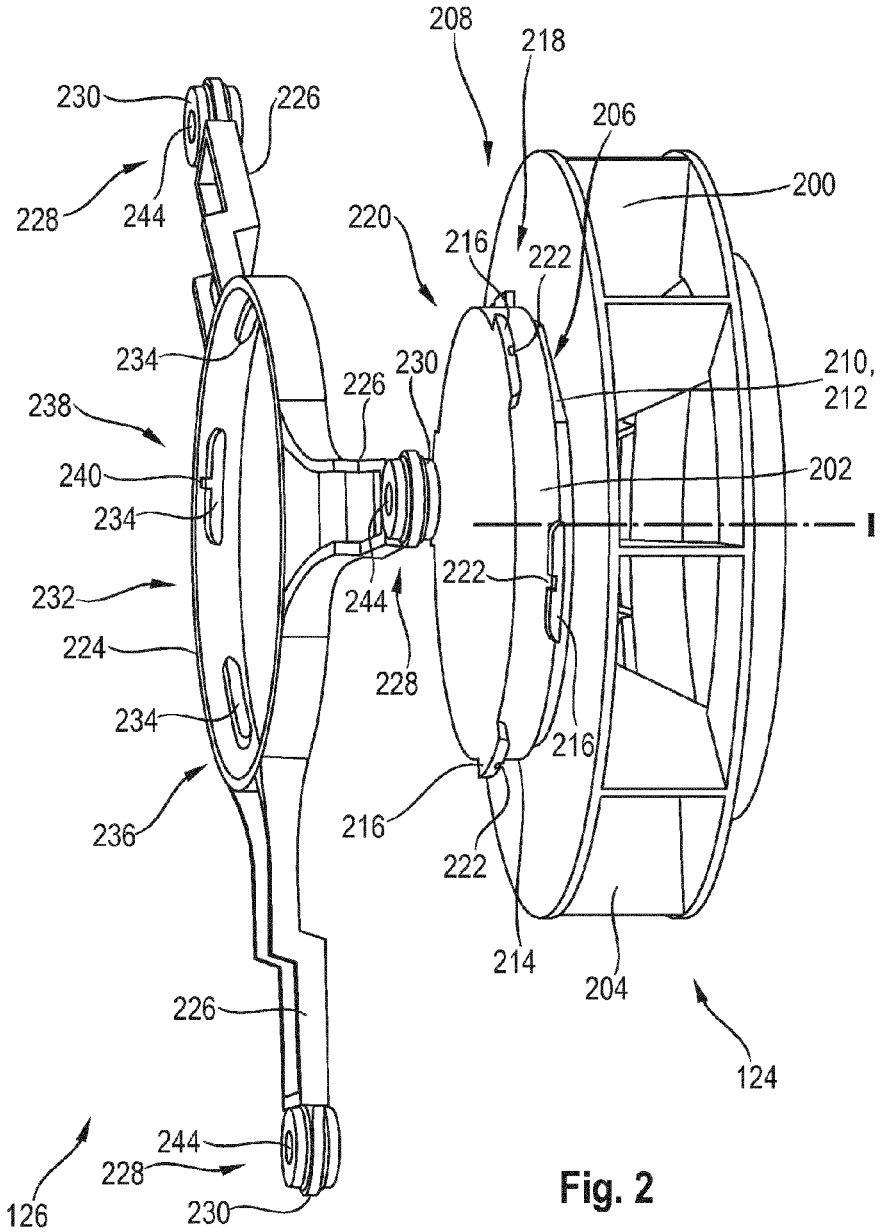
FIG. 2 shows an exploded representation of the fan module.

FIG. 2 shows an exemplary embodiment of the fan wheel 124 and the bracket 126, which form the fan module 108 when assembled together.

In the present exemplary embodiment, the fan wheel 124 has a motor-driven fan 200 and a flange 202. In the present exemplary embodiment, the fan 200 is mounted on the flange 202 so as to rotate about a rotational axis I. In the present exemplary embodiment, the fan 200 has a plurality of guide vanes 204 for feeding air.

In the present exemplary embodiment, the flange 202 has a first cylindrical segment 206 and a second cylindrical segment 208 in the direction of extension of the rotational axis I.

In the present exemplary embodiment, the first cylindrical segment 206 has two assembly torque rest surfaces 210, only one of which can be seen in FIG. 2. The assembly torque rest surfaces 210 are used for holding the flange 202 in place during the assembly of the fan module 108. In the present exemplary embodiment, the two assembly torque rest surfaces 210 are formed by one flat 212 in each case.

In the present exemplary embodiment, the second cylindrical segment 208 has a cylindrical shell surface 214. In the present exemplary embodiment, a plurality of fan wheel latch elements 216 are provided on the cylindrical shell surface 214, which are arranged on the cylindrical shell surface 214 with equal spacing from each other in the peripheral direction. Furthermore, in the present exemplary embodiment, the fan wheel latch elements 216 extend radially outward.

In the present exemplary embodiment, the fan latch elements 216 form a first fan wheel latch element group 218 and a second fan wheel latch element group 220, the fan wheel latch elements 216 in the first fan wheel latch element group 218 being arranged offset with respect to the fan wheel latch elements 216 in the second fan wheel latch element group 220 in the direction of extension of the rotational axis I of the fan 200.

Furthermore, in the present exemplary embodiment, each fan wheel latch element 216 has a recess 222. In this respect, in the present exemplary embodiment, the fan wheel latch elements 216 of the first fan wheel latch element group 218 have an orientation toward the bracket 126, while the fan wheel latch elements 216 of the second fan wheel latch element group 220 have an orientation opposed to this, that is to say away from the bracket 126.

In the present exemplary embodiment, the bracket 126 has a ring 224 to which three arms 226 are connected. Each of the three arms 226 has one decoupling element 230 in each case at its distal end 228, which element is intended to reduce the transmission of mechanical vibrations of the fan module 108 to the refrigeration device 100. For this purpose, in the present exemplary embodiment, the decoupling elements 230 are produced from a flexible material, such as rubber for example.

In the present exemplary embodiment, the ring 224 has an inner surface 232 on which a plurality of bracket latch elements 234 are provided, which are arranged on the inner surface 232 with equal spacing from each other in the peripheral direction. Furthermore, in the present exemplary embodiment, the bracket latch elements 234 extend radially inward.

In the present exemplary embodiment, the bracket latch elements 234 form a first bracket latch element group 236 and a second bracket latch element group 238, the bracket latch elements 234 in the first bracket latch element group 236 being arranged offset with respect to the bracket latch elements 234 in the second bracket latch element group 238 in the direction of extension of the rotational axis I of the fan 200.

Furthermore, in the present exemplary embodiment, each bracket latch element 234 has a lug 240. In this respect, in the present exemplary embodiment, the bracket latch elements 234 in the first bracket latch element group 236 have an orientation toward the flange 202, while the bracket latch elements 234 in the second bracket latch element group 238 have an orientation opposed to this, that is to say away from the flange 202. Thus the lugs 240 can engage in the respective recesses 222 and form the latch connection 128, which ensures the connection of the fan wheel 124 and the bracket 126.

In the present exemplary embodiment, the decoupling elements 230 have a through-hole 244 in each case for securing the fan module 108 to the housing front side part 120.

Figure 3:
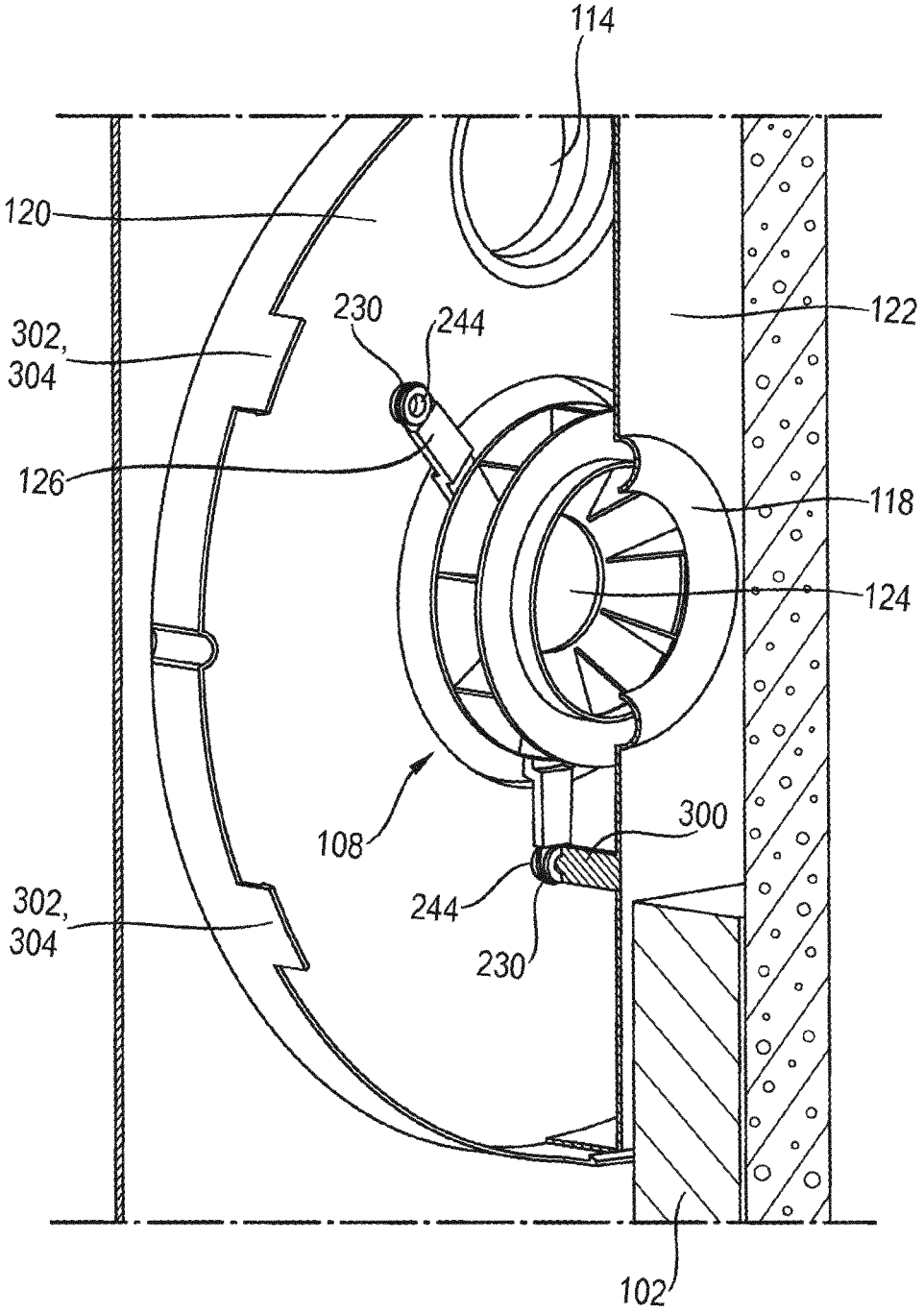
FIG. 3 shows a perspective representation of a fan module assembled in a refrigeration device.

FIG. 3 shows, in a partial cutaway representation, a fan unit 130 built into the refrigeration device 100, the fan module 108 being accommodated in the housing 116.

Shown in FIG. 3 is one of three support studs 300 in the present exemplary embodiment, which extends through one of the three through-holes 244. In the present exemplary embodiment, the three support studs 300 are arranged with equal spacing from each other at an angle of 120° on a circular path.

In the present exemplary embodiment, the support stud 300 is integrally molded on the housing rear side part 122. Like the housing rear side part 122, the support stud 300 can be produced from plastic, e.g. by way of injection molding. In the present exemplary embodiment, therefore, the housing rear side part 122 is realized as one continuous piece together with the support stud 300. Furthermore, in the present exemplary embodiment, the intake nozzle 118 is integrally molded on the housing rear side 112.

FIG. 3 also shows that in the present exemplary embodiment, the air outlet opening 114 is assigned to the housing front side part 120.

Additionally, FIG. 3 shows that in the present exemplary embodiment, a housing front side latch element 302 is arranged on the housing front side part 120. In the present exemplary embodiment, the housing front side latch element 302 is realized in the form of a latch hook 304. In the present exemplary embodiment, the latch hook 304 is integrally molded on the housing front side part 120. Like the housing front side part 120, the latch hook 304 can be produced from plastic, e.g. by way of injection molding. In the present exemplary embodiment, therefore, the housing front side part 120 is realized as one continuous piece together with the latch hook 304.

Figure 4:
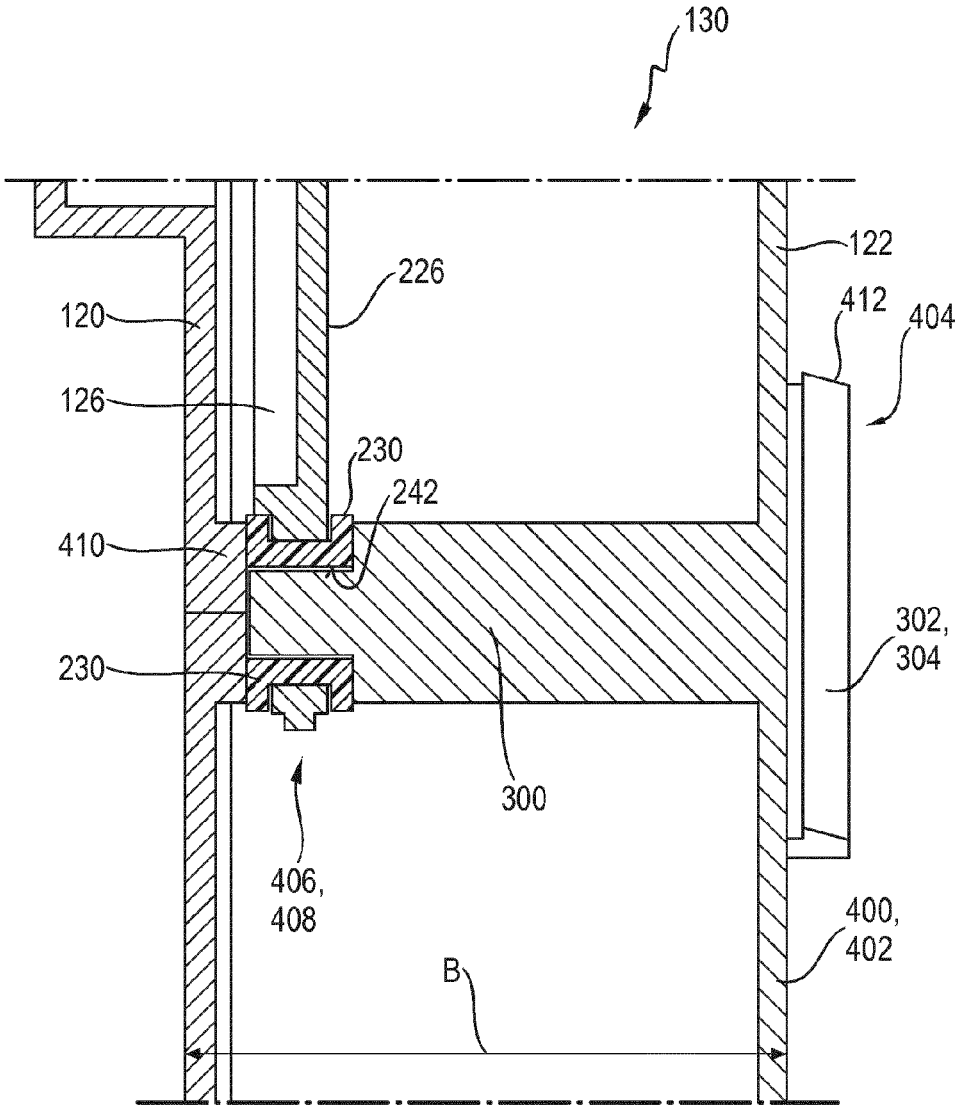
FIG. 4 shows a section through a segment of FIG. 3.

FIG. 4 shows that in the case of the fan unit 130 in the present exemplary embodiment, the latch hook 304 extends over the entire width B of the housing 116 in the direction of extension of the rotational axis I as far as a rear side 400 of the housing rear side part 122. In the present exemplary embodiment, the housing rear side part 122 therefore forms a housing rear side latch element 402, which, being in contact with the latch hook 304, forms a latch connection 404 that connects the housing front side part 120 and the housing rear side part 122 to each other. FIG. 4 also shows that the latch hook 304 in the present exemplary embodiment has a sloping connecting part 412 that simplifies assembly since it effects an independent deflection of the latch hook 304 during assembly.

Furthermore, FIG. 4 shows that the support stud 300 extends through the through-hole 242 of the decoupling element 230. For the purpose of holding the decoupling element 230 in place, the support stud 300 has a collar 408 at its distal end 406.

Additionally, FIG. 4 shows that in the present exemplary embodiment the housing front side part 120 has an end support 410. In the present exemplary embodiment, the end support 410 is integrally molded on the housing front side part 120. Like the housing front side part 120, the end support 410 can be produced from plastic, e.g. by way of injection molding. In the present exemplary embodiment, therefore, the housing front side part 120 is realized as one continuous piece together with the end support 410.

The end support 410 acts together with the support stud 300, which in the present exemplary embodiment is in contact with the end support 410 at its distal end 406 for this purpose. The end support 410 can form a further latch connection with the support stud 300 to hold the support stud 300 in place at its distal end 406.

The assembly of the fan unit 130 will now be explained on the basis of FIGS. 5 to 8.

Figure 5:
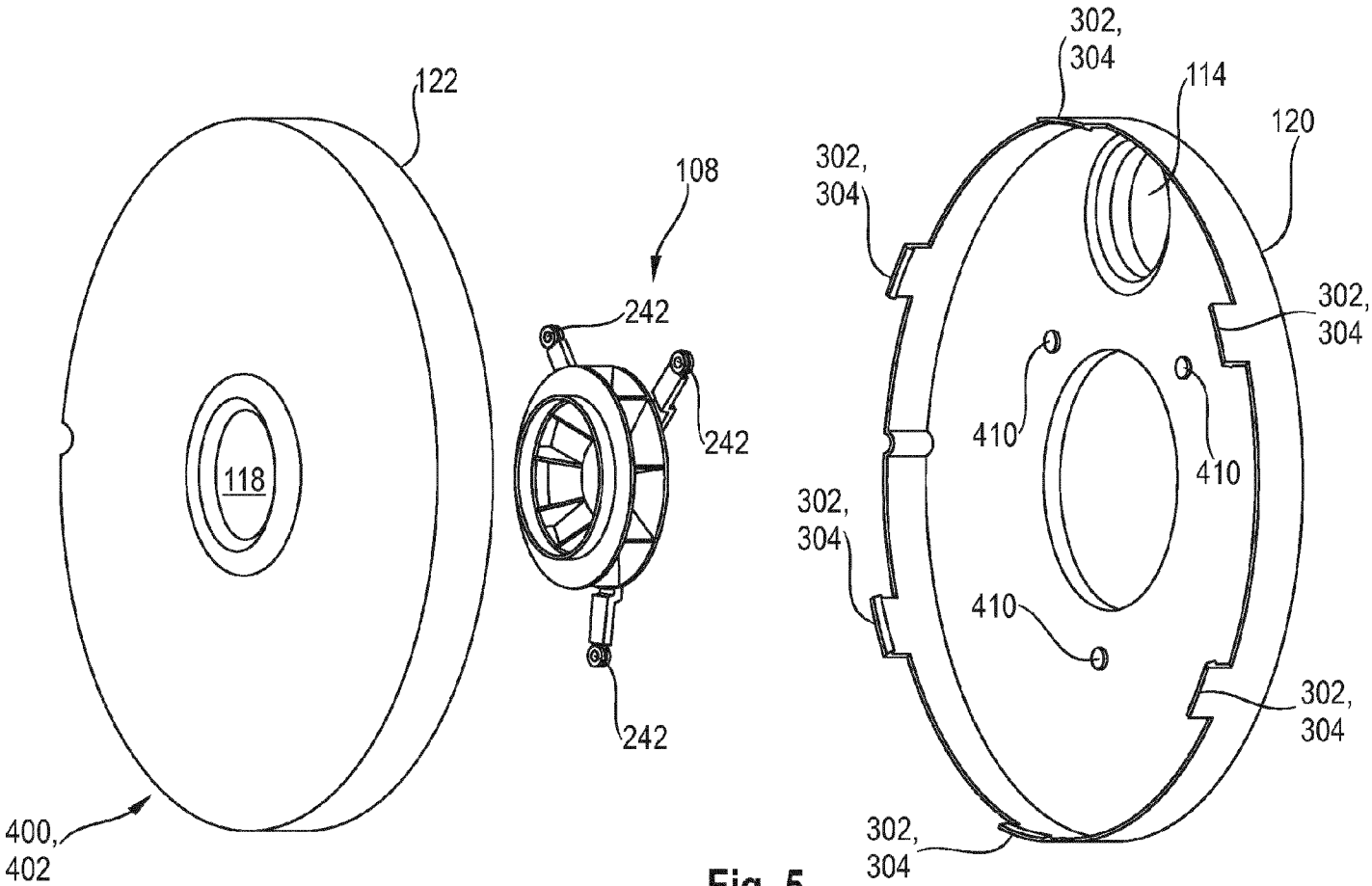
FIG. 5 shows a first stage in assembly.
Figure 6:
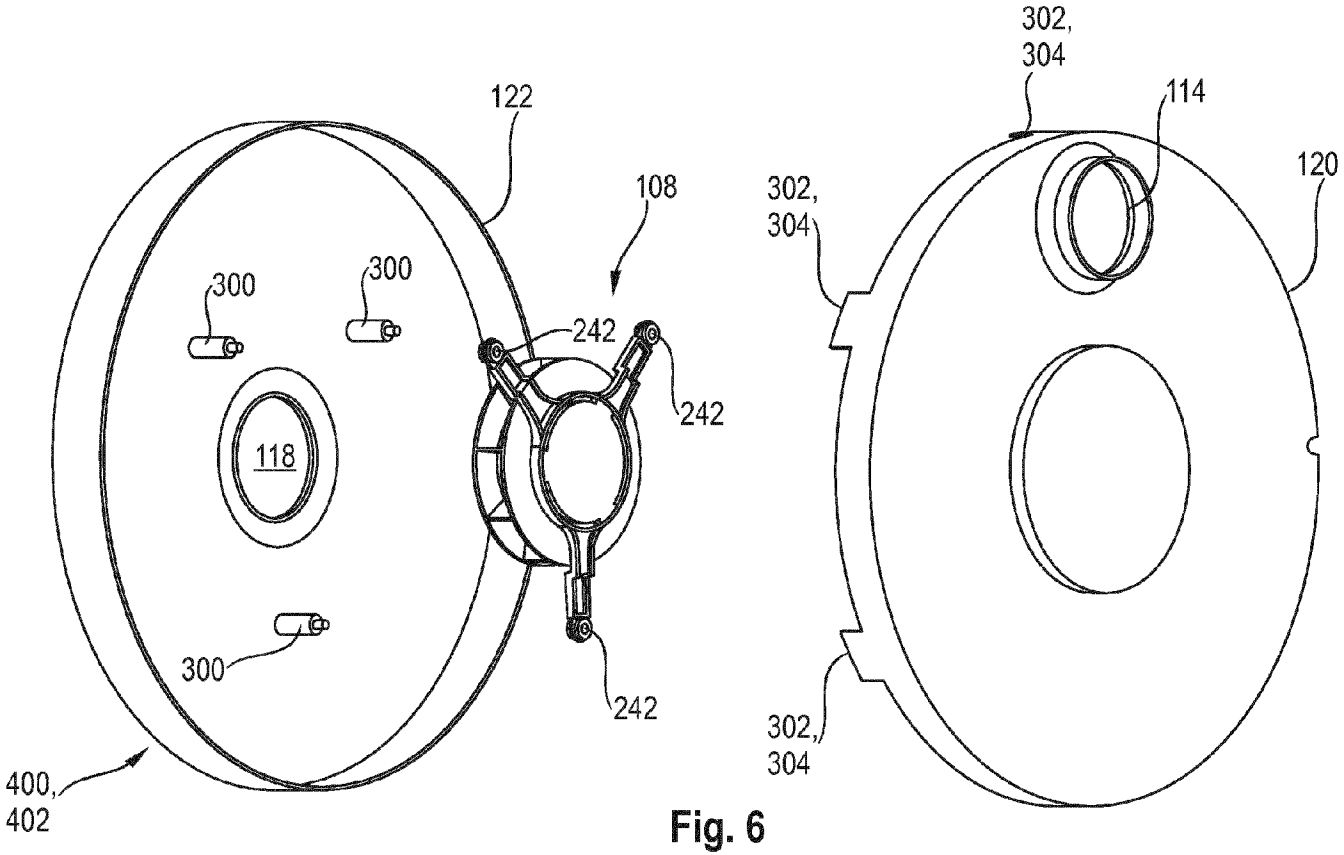
FIG. 6 shows a further view of the first stage in assembly.

FIGS. 5 and 6 show the fan module 108 which in the present exemplary embodiment has three through-holes 242. Furthermore, FIGS. 5 and 6 show the housing rear side part 122 together with the rear side 400, which in the present exemplary embodiment is realized in the form of a housing rear side latch element 402. Furthermore, in the present exemplary embodiment, the housing rear side part 122 has three support studs 300, which are integrally molded on the housing rear side part 122, and also the integrally molded intake nozzle 118. Finally, FIGS. 5 and 6 show the housing front side part 120 together with, in the present exemplary embodiment, three support points 410. Furthermore, in the present exemplary embodiment, the housing front side part 120 has six housing front side latch elements 302 realized in the form of latch hooks 304, which are integrally molded on the housing front side part 120, and also the air outlet opening 114.

Figure 7:
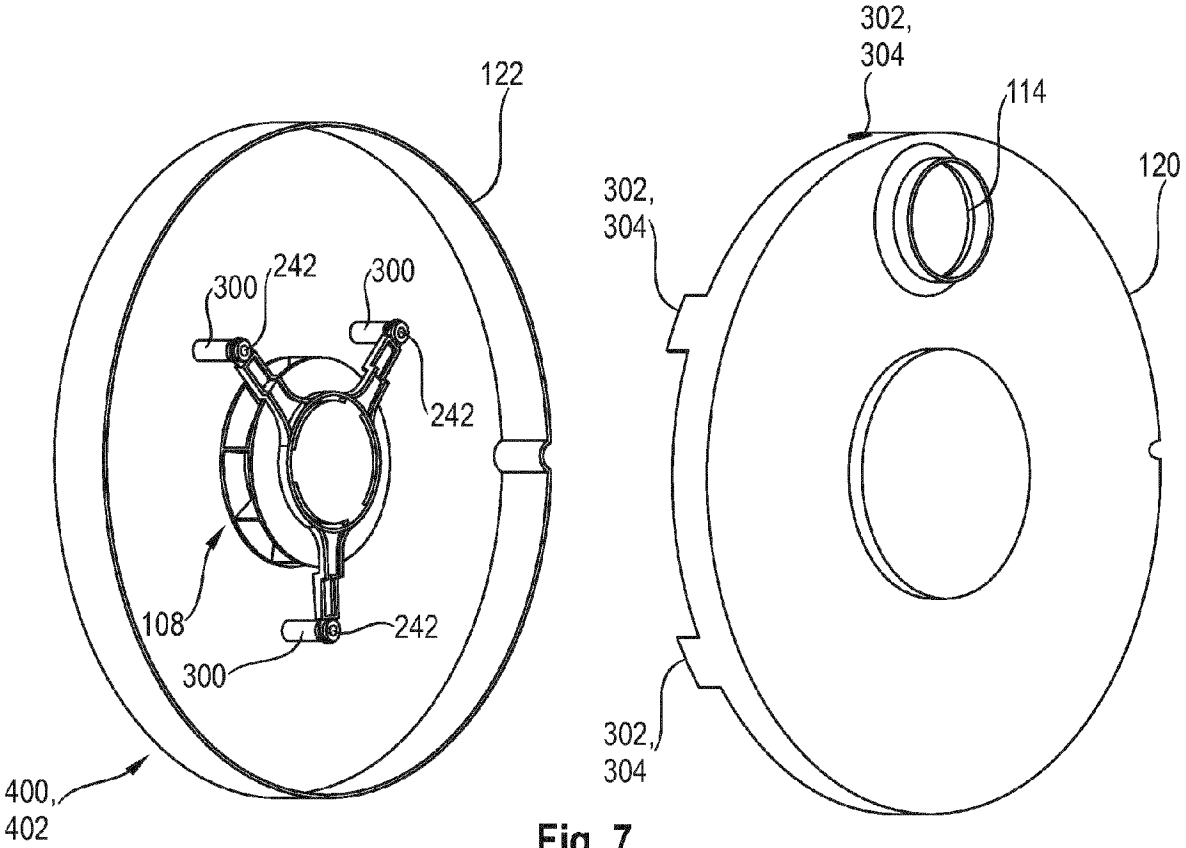
FIG. 7 shows a further stage in assembly.

FIG. 7 shows a first stage in assembly.

In the first stage of assembly, the fan module 108 is moved such that the support studs 300 extend through the through-holes 242. This movement is stopped by the collar 408 (see FIG. 4) so that the position shown in FIG. 7 is reached, in which the fan module 108 is connected to the housing rear side part 122.

Figure 8:
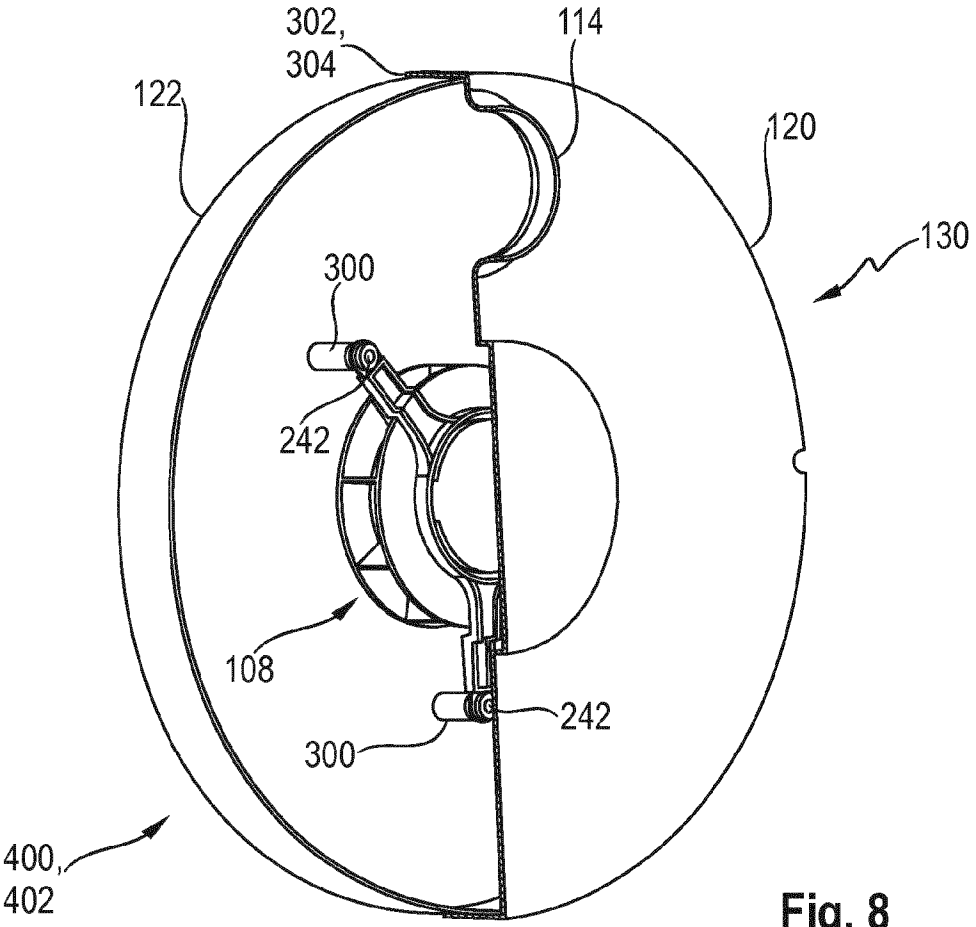
FIG. 8 shows a further stage in assembly.

FIG. 8 shows a further stage in assembly.

In the further stage, the housing front side part 120 is then moved until the six latch hooks 304 snap over the rear side 400 of the housing rear side part 122 and thus the latch connection 404. The fan unit 130 assembled in this way can then be built into the refrigeration device 100.

LIST OF REFERENCE CHARACTERS

| | |
|---|---|
| 100 | Refrigeration device |
| 102 | Evaporator |
| 104 | Inner container |
| 106 | Foam |
| 108 | Fan module |
| 110 | Air duct |
| 112 | Air inlet opening |
| 114 | Air outlet opening |
| 116 | Housing |
| 118 | Intake nozzle |
| 120 | Housing front side part |
| 122 | Housing rear side part |
| 124 | Fan wheel |
| 126 | Bracket |
| 128 | Latch connection |
| 130 | Fan unit |
| 200 | Fan |

-continued

| | |
|---|---|
| 202 | Flange |
| 204 | Guide vane |
| 206 | First cylindrical segment |
| 208 | Second cylindrical segment |
| 210 | Assembly torque rest surfaces |
| 212 | Flat |
| 214 | Shell surface |
| 216 | Fan wheel latch elements |
| 218 | First fan wheel latch element group |
| 220 | Second fan wheel latch element group |
| 222 | Recess |
| 224 | Ring |
| 226 | Arm |
| 228 | Distal end |
| 230 | Decoupling element |
| 232 | Inner surface |
| 234 | Bracket latch element |
| 236 | First bracket latch element group |
| 238 | Second bracket latch element group |
| 240 | Lug |
| 242 | Through-hole |
| 300 | Support stud |
| 302 | Housing front side latch element |
| 304 | Latch hook |
| 400 | Rear side |
| 402 | Housing rear side latch element |
| 404 | Latch connection |
| 406 | Distal end |
| 408 | Collar |
| 410 | End support |
| 412 | Sloping connecting part |
| B | Width |
| I | Rotational axis |

The invention claimed is:

1. A refrigeration device, comprising:

a housing having a housing front side part and a housing rear side part;

a fan accommodated in said housing, said fan secured to said housing rear side part and is held in place by said housing front side part; and said housing rear side part having at least one support stud for slipping on said fan.

2. The refrigeration device according to claim 1, further comprising a decoupling element disposed between said support stud and said fan.

3. The refrigeration device according to claim 2, wherein said decoupling element is a flexible rubber molding.

4. The refrigeration device according to claim 2, wherein said decoupling element can be slipped onto said support stud.

5. The refrigeration device according to claim 1, wherein said support stud has a pin segment with a stop for slipping on said fan.

6. The refrigeration device according to claim 1, wherein said support stud is formed as one continuous piece with said housing rear side part.

7. The refrigeration device according to claim 1, wherein said support stud is cylindrical in shape.

8. The refrigeration device according to claim 1, wherein said housing front side part has an end support, said support stud is in contact with said end support for holding said fan in place.

9. The refrigeration device according to claim 8, wherein said end support is a projecting segment of said housing front side part.

10. The refrigeration device according to claim 1, wherein said housing rear side part has three support studs for slipping on said fan.

11. The refrigeration device according to claim 10, wherein said three support studs are disposed in a circle at an angle of 120° to each other respectively.

12. The refrigeration device according to claim 1, further comprising:

a fan wheel having said fan; and a bracket for slipping on said fan and for holding said fan wheel, said fan wheel and said bracket forming a fan module.

13. The refrigeration device according to claim 1, wherein said housing front side part has a housing front side latch for latching in said housing rear side part or said housing rear side part has a housing rear side latch for latching in said housing front side latch element.

14. The refrigeration device according to claim 1, wherein said fan is clamped between said housing front side part and said housing rear side part.

* * * * *